US005566732A

United States Patent [19]

Nelson

[11] Patent Number: 5,566,732

[45] Date of Patent: Oct. 22, 1996

[54] BEVERAGE DISPENSER WITH A READER FOR SIZE INDICA ON A SERVING CONTAINER

[75] Inventor: Patrick L. Nelson, Sun Prarie, Wis.

[73] Assignee: Exel Nelson Engineering LLC, Madison, Wis.

[21] Appl. No.: 492,881

[22] Filed: Jun. 20, 1995

[51] Int. Cl.[6] ..... B65B 1/04; B65B 3/00

[52] U.S. Cl. ..... 141/94; 141/351; 222/23; 222/129.1; 222/640

[58] Field of Search ..... 141/94, 351; 222/23, 222/30, 640, 641, 129.1, 504, 481, 478

[56] References Cited

U.S. PATENT DOCUMENTS

| | | | |
|---|---|---|---|
| 2,380,884 | 7/1945 | Stoeser et al. | 222/640 |
| 3,718,233 | 2/1973 | Nordhoff | 222/641 |
| 4,202,387 | 5/1980 | Upton | 141/94 |
| 4,360,128 | 11/1982 | Neumann | 222/641 |
| 5,203,474 | 4/1993 | Haynes | 222/129.1 |
| 5,268,849 | 12/1993 | Howlett et al. | 141/94 |

*Primary Examiner*—Henry J. Recla
*Assistant Examiner*—Steven O. Douglas
*Attorney, Agent, or Firm*—Quarles & Brady

[57] ABSTRACT

A beverage dispenser fills a container with a beverage by controlling beverage flow through a nozzle with a valve. A mechanism reads an indicia printed on the container which identifies a volume for that container. The volume information is sent to a controller which responses by activating the valve to dispense a quantity of beverage that corresponds to the volume indicated by the indicia. Thus the beverage dispenser is able to automatically fill containers of different sizes by reading each containers volume indicating indicia. The indicia also may indicate a unique serial number assigned to each container. In that case, the controller stores data in memory which identify serial numbers of containers into which beverage has been dispensed previously and the dispensing is inhibited if the server attempts to refill one of those containers.

13 Claims, 2 Drawing Sheets

BEVERAGE DISPENSER WITH A READER FOR SIZE INDICA ON A SERVING CONTAINER

BACKGROUND OF THE INVENTION

The present invention relates to automated dispensing equipment for filling an open container with a beverage.

It is common for carbonated beverages, such as soda and beer, to be supplied to a vendor in a sealed canister or keg which then is connected to a tap at the vendor's establishment. Pressurized gas, such as carbon dioxide, is injected into the beverage canister or keg to push the liquid beverage through an outlet tube to the tap where it is dispensed into cups, mugs and pitchers. Carbonated soda is also supplied to vendors as a concentrate, or syrup, which is mixed at the tap with carbonated water from another source at the vendor's establishment.

Regardless of which type of dispensing method is utilized, the carbonated beverage usually foams while being dispensed into the serving container. As a consequence, personnel operating the dispenser must fill the serving container until the level of foam reaches the brim and then wait for the foam to settle before adding additional beverage. In some instances several iterations of this process must occur before the container is filled with liquid to the proper serving level. "Topping off" necessitated by the foaming of the beverage prolongs the dispensing operation and impedes the ability to fully automate the dispensing of carbonated beverages.

Nevertheless many establishments have push buttons activated taps which automatically dispense measured quantities of beverage into different sized serving containers, such as glasses, mugs and pitchers. However, automated equipment only can partially fill the serving container and the user still must manually top-off the container after the foam from the automated step has settled in order to dispense the proper serving quantity.

Dispensing beverage from the canister or keg also is prone to a certain amount of shrinkage. For example, the amount of beverage which foams over the brim of the serving container during the dispensing operation is lost. In addition, quantities of the beverage may be dispensed into containers for which payment is not received, as occurs when the server hands out free drinks to friends. A significant percentage of the volume in the canister or keg may be lost due to shrinkage.

Automated dispensing is very useful in large volume carbonated beverage operations, such as at sports arenas and stadiums, where it is desirable to fill each container to the full serving level as fast as possible. Such large scale dispensing operations also must be performed with minimal shrinkage due to waste and pilferage. On common way of regulating beverage dispensing is to count the number of containers into which beverage is dispensed. This is commonly done by multiplying the number of used plastic sleeves in which the containers were supplied to a dispensing station by the number of containers in each sleeve. That container count should equal the number of servings of that size beverage tabulated by the cash register for that serving station. A significant discrepancy indicates waste or pilferage such as the refilling of previously used containers.

SUMMARY OF THE INVENTION

A general object of the present invention is to provide an apparatus for automatically dispensing carbonated beverages into a serving container in a manner which minimizes foaming of the beverage and permits rapid dispensing to occur. Thus such apparatus is particularly suited to high volume dispensing operations.

Another object of the present invention is to provide such an apparatus which minimizes shrinkage due to wasted beverage during the dispensing operation.

These an other objectives are fulfilled by a beverage dispenser that has a nozzle with an outlet through which the beverage is dispensed into a container. A valve controls the flow of the beverage through the nozzle. A mechanism, such as a bar code reader for example, reads an indicia on the container when placed beneath the nozzle, wherein the indicia indicates a volume for that container. A controller responds to a signal from the mechanism, which indicates the volume for the container, by operating the valve to dispense an given amount of beverage that is determined based upon that signal.

In the preferred embodiment, the indicia on the container also encodes a serial number for the container. In this case, the controller maintains a list which indicates serial numbers of containers into which beverage has been dispensed previously. The controller responds to the signal from the mechanism by operating the valve to dispense beverage from the nozzle only if the list does not indicate that beverage was previously dispensed into a container having the same serial number as the container that has been placed beneath the nozzle.

DETAILED DESCRIPTION OF THE INVENTION

Figure 1:
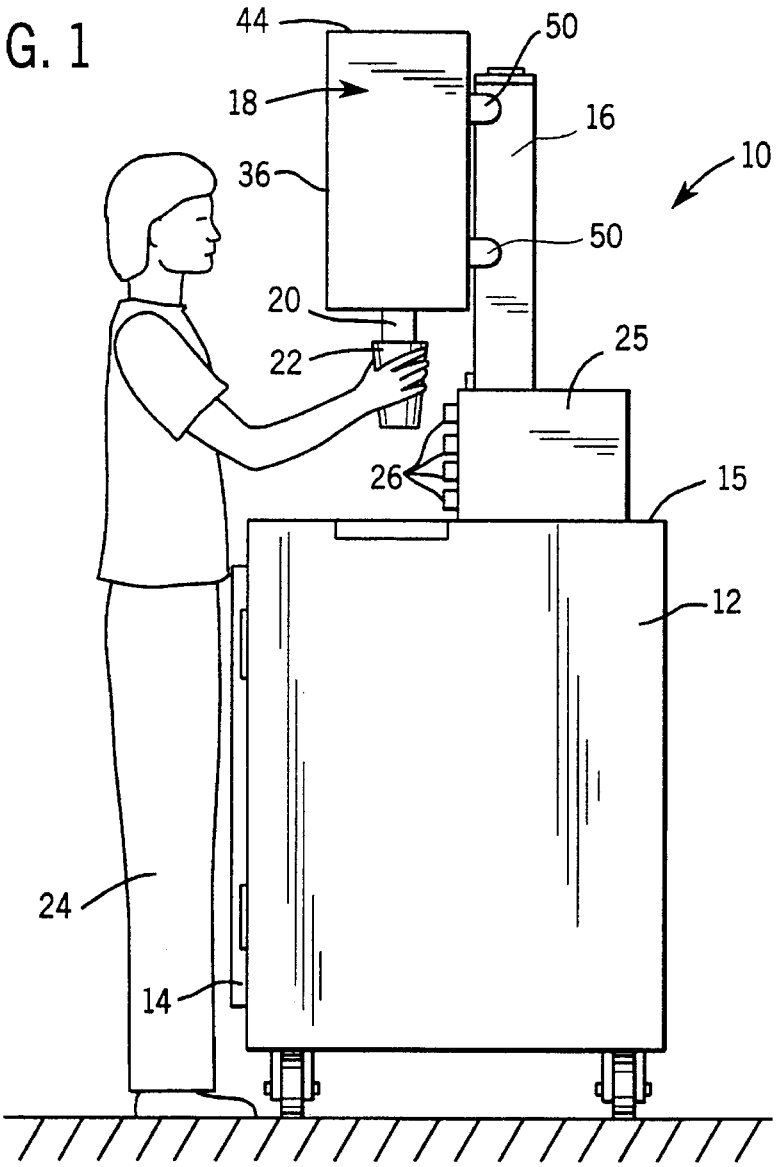
FIG. 1 is a side view of a carbonated beverage dispensing station according to the present invention.

FIG. 1 depicts a carbonated beverage dispensing apparatus 10 of a type that is commonly used in fast-food establishments and sports venues. The apparatus 10 consists of a refrigeration unit 12 that forms a closed chamber within which canisters or kegs of the beverage to be dispensed are stored. Refrigeration unit 12 includes a conventional compressor operated refrigeration system which cools the chamber to a desired serving temperature for the beverage. In addition, the refrigeration unit 12 either contains a cylinder of carbon dioxide or fittings to attach to an external carbon dioxide source to supply gas which forces the carbonated beverage out of the canister or keg to a dispenser 18, as is common practice. The refrigeration unit 12 includes a door 14 for access to the chamber in order to insert and remove the canisters or kegs of carbonated beverage.

A hollow pillar 16 extends upward from the top surface 15 of the refrigeration unit 12 and has the dispenser 18 attached thereto. Extending downward from the dispenser 18 is the nozzle 20 through which the carbonated beverage is dispensed into a serving container 22, such as cup, held thereunder by a human server 24. The dispensing operation is controlled via a computer 25 connected to a plurality of push-button switches 26 by which the operator selects different functions to be performed. The computer 25 may be a commercially available programmable logic controller (PLC) commonly used in commercial and industrial control applications.

Figure 2:
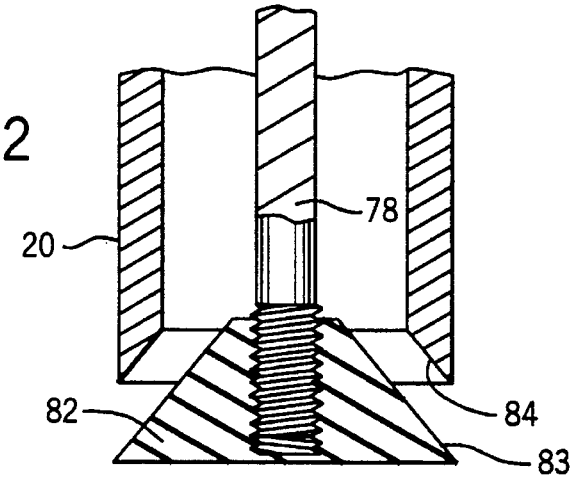
FIG. 2 is a cross section through the dispenser mechanism at the beverage dispensing station.

With reference to FIG. 2, dispenser 18 has a cylindrical shape and comprises a housing 28 within which is contained a tank 30 made of stainless steel or other material approved for food handling. The tank 30 has a cylindrical upper section 32 with a conical bottom 34 that has the larger diameter end welded inside the upper tank section 32. The tubular nozzle 20 of stainless steel is welded to the smaller end of the conical tank bottom 34 and extends downward out of the housing 28. The housing 28 comprises a thin outer shell 36 with insulating material 38 adhesively applied to its inner surface. Additional insulation can be provided above and below the tank 30. The outer housing shell 36 is a sheet, of stainless steel for example, that is curved to wrap around the outside of the tank 30 with the abutting ends of the sheet being adjacent to pillar 16 and held together by a series of clamps 48. A number of spacers 40 are located between the tank 30 and the outer housing shell 36 to maintain the two components spaced apart forming a cavity 42 therebetween. The spacers either have holes therethrough or do not extend entirely around the tank 30 to permit vertical air flow in the cavity 42. The ends of the outer housing shell 36 are closed by top and bottom covers 44 and 46, respectively. The bottom cover 46 is welded to the bottom end of the tank 30. The upper housing cover 44 merely fits snugly into the upper end of the outer housing shell 36 held therein by friction so as to be removable for access to the tank. It should be noted that the upper housing cover 44 does not provide an airtight seal and thus the interior 35 of the tank 30 is at atmospheric pressure.

The tank 30 is structurally attached to pillar 16 by upper and lower support tubes 50 and 51 each having one end welded into openings in the pillar 16 and another end welded to the exterior surface of the tank. As shown in FIG. 2, the lower end of the hollow pillar 16 extends through a hole in the top surface 15 of the refrigeration unit 12 so that various tubes and wires can extend from the refrigeration unit to the dispenser 18, as will be described in detail. Alternatively, the dispenser 18 can be mounted on a counter top with supply tubes extending from beverage canisters or kegs stored in a separate refrigerator.

Flexible beverage supply tube 52 extends from the beverage canister or keg up through the pillar 16 and into the lower support tube 51. The upper end of the beverage supply tube 52 projects through a gasket seal 54 within the lower supply tube 51 and has a rigid tank supply tube 56 inserted therein. The tank supply tube 56 extends from the lower support tube 51 through an aperture in the tank 30 with a gasket 58 providing a fluid-tight seal between the tank and the supply tube 56. The tank supply tube 56 bends downward in the tank interior 35 and has an open end 59 within the conical bottom 34 of the tank. The open end 59 directs the carbonated beverage tangentially to the curved interior surface of conical bottom 34 to reduce turbulence of the beverage flowing into the tank.

A chilled air supply tube 60 has one end connected to the outlet of a blower 62 located within the chamber 64 of the refrigeration unit 12. The chilled air supply tube 60 extends upward through the pillar 16 terminating within the lower support tube 51 after passing through the gasket seal 54. As will be described in detail, cool air from the refrigeration unit chamber 64 is blown through the chilled air supply tube 60 into the cavity 42 between the tank 30 and the housing 28. The air circulates upward through that cavity 42 and exits via the upper support tube 50 flowing downward through the hollow pillar 16 back into the refrigeration unit chamber 64. This air circulation cools the tank 30 and the beverage contained therein.

A vent tube 66 extends from the upper region of the tank interior 35 through a sealed opening in the tank 30, the upper support tube 50 and pillar 16 to a floor drain which services the dispensing apparatus 10. The vent tube 66 provides an overflow passage should the beverage within the tank 30 approach the upper end. In addition, since the remote end the tube merely is placed adjacent to a floor drain rather than being sealed to a plumbing waste line, air is able to enter from the remote end and pass into the tank interior 35 thereby maintaining the interior at atmospheric pressure. Atmospheric air flows in and out of the tank interior 35 through the vent tube 66 as the level of beverage 65 within the tank 30 rises and falls.

A level sensor 68 is located near the top of the upper tank section 32 and comprises a conventional float actuated switch which closes when the level of beverage within the tank reaches a defined level. Other types of level sensors may be used in place of the float-type device shown. The level sensor 68 provides an electrical level signal to the computer 25, shown in FIG. 1. A cleaning tube 70 extends from a fitting located on refrigeration unit 12 upward through pillar 16 into the top of housing 28 and then downward into the tank 30. The end of the cleaning tube 70 within the tank interior 35 has a spray ball 72 attached thereto. The spray ball 72 is hollow with holes in its surface to spray fluid from the cleaning tube 70 in a 360 degree pattern within the tank. Periodically the tank 30 is drained of beverage and a soap solution and rinse water are sequentially sent through the cleaning tube 70 to wash the interior of tank 30.

Figure 3:
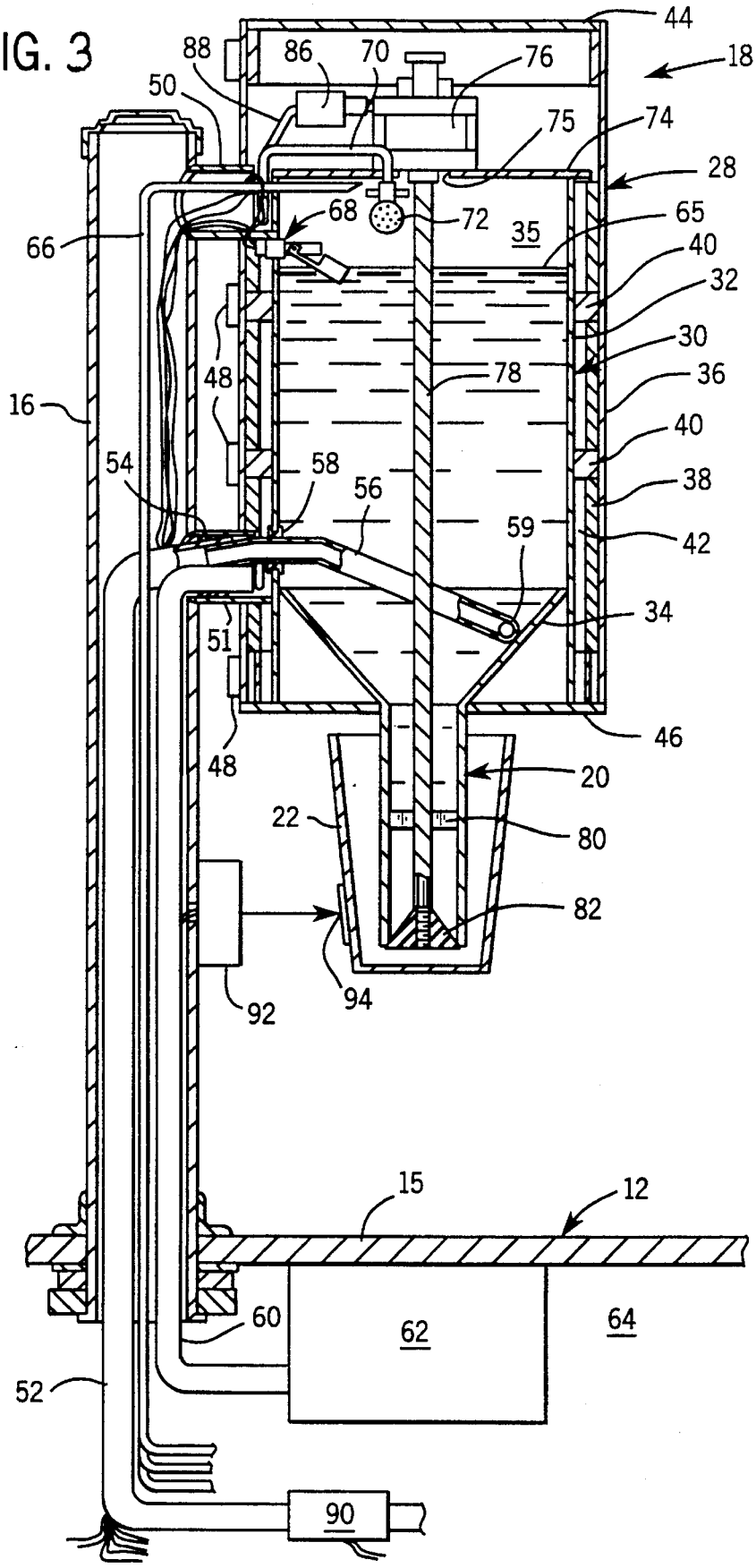
FIG. 3 is a cross section through an outlet of the dispenser mechanism showing the control valve in an open state.

The top of tank 30 has a plate 74 there across with a central opening 75. A pneumatic solenoid actuator 76 is mounted over the opening in the plate 74 and has an armature to which a valve rod 78 is attached. The valve rod 78 extends downward through the tank 30 and the nozzle 20 wherein a star-shaped pilot 80 spaces the valve rod centrally within the nozzle. The remote end of the valve rod 78 is threaded into an aperture within a rubber valve member 82. The valve member 82 has a conical shape with tapering sidewalls 83 that nests within a tapered outlet 84 in the lower end of the nozzle 20 (see FIG. 3). When the valve member 82 is retracted into the nozzle 20, the tapered walls of the valve member tightly engage the tapered nozzle outlet 84 to close the end of the nozzle preventing beverage from flowing therethrough from the tank 30. Alternately, when the pneumatic actuator 76 is energized to dispense beverage, the valve rod 78 and valve member 82 are extended downward as shown in FIG. 3 producing an opening at the end of nozzle 20.

The inlet to the pneumatic actuator 76 is connected to a first electrically operated valve 86 which controls the flow of carbon dioxide to the actuator 76 from a supply line 88 connected to the cylinder that supplies carbon dioxide to the dispensing apparatus 10. Pressurized air also can be used to operate the pneumatic actuator 76. Alternatively, an electromagnetic solenoid actuator can be employed to operate the value rod 78.

With continuing reference to FIG. 2, a conventional bar code reader 92 is mounted on the pillar 16 facing the lower end of the nozzle 20. A bar code 94 is printed on the outside of each container 22 that is to be filled with carbonated beverage. A plurality codes may be printed at several locations around the outer circumference of the container 22 so that one of the bar codes is visible to the bar code reader 92 regardless of the rotational orientation at which the server holds the container under the nozzle. The bar code 94 indicates the container's size and a unique serial number for the container 22. The container size can be encoded by the bar code indicia as the actual volume, where the number twelve indicates a twelve ounce cup, or the size can be encoded as a single digit, where the number 3 indicates a twelve ounce cup for example. The information that is read by bar code reader 92 is communicated to the computer 25 via a set of wires. Alternatively, the container's size and unique serial number may be encoded on the containers by other forms of indicia that can be automatically read by the dispensing system.

In order to dispense a beverage from apparatus 10, a server 24 places the desired size serving container 22 beneath the nozzle 20 so that the nozzle outlet 84 is closely spaced from the bottom of the container. If the beverage is of the type that normally is served with ice, the ice is added to the container after the beverage. The bar code reader 92 continuously scans the region between the pillar 16 and the dispensing nozzle 20. When the serving container is raised upward, the bar code reader scans the bar code on the container 22 and transmits the bar code data to the computer 25.

The computer 25 maintains a list in memory of the serial numbers of serving containers into which beverage had been dispensed previously. For example a separate serial number list may be maintained for each different size of serving container being used. In response to receiving the serial number read from the serving container 22 placed beneath nozzle 20, the computer looks up that serial number in the list in memory. If that serial number is in the list already, the dispensing of beverage into that serving container is inhibited and a light on the front of the computer 25 indicating that event is illuminated. Thus any attempt to refill a serving container in which beverage was previously sold is prevented. The list is cleared each day prior to commencing operation.

If the serial number of the serving container beneath the nozzle 20 is not in the list in the computer's memory, that serial number is added before the dispensing operation commences. In that case, the computer 25 then uses the bar code information indicating the container size to determine how long a time interval the valve member 82 must be held open to dispense that quantity of beverage. For example, a look-up table in memory can provide the time intervals for each of the container sizes. The time interval is used to set a timer within the computer 25. The flow rate of beverage out of nozzle 20 is relatively constant with insignificant variation occurring as the height of the beverage within the tank 30 drops during dispensing. Therefore, a known relationship exists between the time that valve member 82 is in the open state and the quantity of beverage dispensed.

Next computer 25 applies power to the first electrically operated valve 86 to supply pressurized gas to the pneumatic actuator 76. This action causes the actuator 76 to extend the valve rod 78 and the attached valve member 82 downward, opening the bottom end of the nozzle 20. Thus beverage stored within tank 30 will flow downward through the nozzle 20 and into the serving container 22. The tapered sidewalls 83 of the valve member 82 distributes the beverage evenly in a 360 degree pattern around the valve member. This dispensing pattern minimizes the turbulence within the dispensed beverage and, thus minimizes foaming. As beverage flows into the serving container 22, the server 24 lowers the serving container so that the volume of the nozzle 20 does not take up space therein which should otherwise be filled with the beverage. Alternatively, the serving container can be placed on an elevator which raises and then automatically lowers the serving container as beverage is dispensed. This downward movement of the serving container is controlled so that except for momentarily when the valve is first opened, the lower end of the nozzle 20 always will be below the level of beverage dispensed into the serving container. Thus, the beverage flowing from the nozzle opening is not mixed with air by turbulence at the nozzle output. It is such introduction of air into the beverage which produces foaming. Therefore by keeping the nozzle outlet below the level of beverage within the serving container, the foaming is minimized.

As the level of beverage within the tank 30 drops during the dispensing operation, the level sensor 68 provides a signal indicating such to the computer 25. In response, the computer 25 energizes a second electrically operated valve 90 in the beverage supply tube 52. That action opens the second electrically operated valve 90 causing beverage to flow from the canister or keg within the refrigeration unit 12 through tubes 52 and 56, and into bottom of the tank 30. This replenishes the volume beverage dispensed from tank. As the beverage 65 within the tank rises to the height of level sensor 68, the sensor switch opens signalling the computer 25 which responds by closing the second electrically operated valve 90 in beverage supply line 52.

The dispensing of beverage from the nozzle 20 continues for a dispensing time interval at the end of which the timer in computer 25 times out. When that event occurs, the computer 25 de-energizes the first electrically operated valve 86 on the gas supply line 88 which deactivates the pneumatic actuator 76. A spring within the pneumatic actuator 76 retracts the valve rod 78 and valve member 82 upward into the nozzle 20 closing the nozzle and terminating the flow of beverage. If during the dispensing operation, the bar code reader 92 fails to continuously read the bar code on the serving container 22, as occurs if the server removes that serving container from beneath the nozzle 20, the computer 25 terminates the beverage dispensing by de-energizing the first electrically operated valve 86.

After each dispensing operation, the computer 25 updates a numerical value, representing the total quantity of beverage that has been dispensed, by adding to that total the volume of the serving container 22. By knowing total quantity of beverage that has been dispensed and the volume of a full canister or keg of beverage, the computer 25 is able to calculate the quantity of beverage remaining in the canister or keg. When the supply of beverage is nearing exhaustion, a warning light (not shown) on the front of the computer 25 can be illuminated to alert the server 24 to that fact so that the canister or keg can be replaced. The computer 25 also counts the number of each different sizes of serving containers that are dispensed so as to track the inventory of serving containers and provide management information.

In a large sports venue where there will be numerous dispensing apparatus 10, each computer 25 can be connected via a telephone line or a communication network to a central computer which monitors the operation of all of the dispensing apparatus and provides cumulative sales information for the entire facility. For example, the list of container serial numbers may be stored in the central computer so that a serving container from one beverage stand may not be refilled at another stand.

The count of the different size serving containers and the total quantity of beverage dispensed can be reconciled to determine the amount of waste at the dispensing apparatus 10. Because the amount of foaming during the dispensing operation is kept to a minimum, the amount of waste is reduced as compared with conventional dispensing apparatus. As a consequence, the reconciliation of data is useful in determining whether a specific server is inefficient or may be dispensing beverages without receiving payment, or not depositing payment in the till.

We claim:

1. An apparatus for dispensing a beverage into containers, said apparatus comprising:

a nozzle having an outlet through which the beverage is dispensed;

a valve coupled to said nozzle for controlling the flow of the beverage through said nozzle;

a mechanism for reading an indicia printed on a given container placed under said nozzle, wherein the indicia identifies a volume for the given container, said mechanism producing a signal which indicates the volume for the given container; and a controller which responds to the signal from said mechanism by operating said valve to dispense beverage from said nozzle, wherein a quantity of beverage that is dispensed is determined from the signal.

2. The apparatus as recited in claim 1 wherein:

the indicia also identifies a serial number of the given container;

the signal produced by said mechanism also indicates the serial number of the given container; and said controller stores data which indicates serial numbers of containers into which beverage has been dispensed previously and responds to the signal from said mechanism by operating said valve to dispense beverage from said nozzle only if the data does not indicate that beverage was previously dispensed into a container having an identical serial number as the given container.

3. The apparatus as recited in claim 1 wherein said controller operates said valve to terminate beverage dispensing when said mechanism indicates that the given container has been removed from beneath said nozzle.

4. The apparatus as recited in claim 1 wherein said mechanism is a bar code reader; and the indicia on the given container is a bar code.

5. An apparatus for dispensing a carbonated beverage into a plurality of containers, said apparatus comprising:

a tank having a chamber for holding the carbonated beverage to be dispensed with the chamber being maintained at atmospheric pressure;

an inlet through which the carbonated beverage is introduced into said tank;

an nozzle projecting from said tank, and having an outlet through which the carbonated beverage held in the tank is dispensed;

a valve member movably located at the outlet of said nozzle and having a conical shape which a side wall which tapers from a first end to a second larger end that is larger than the first end, said valve member having a closed position in which the side wall extends into and closes the outlet to beverage flow, and having an open position in which the side wall is spaced from the nozzle to permit beverage flow therebetween wherein the conical shape of said valve member disperses the carbonated beverage at the outlet;

an actuator connected to said valve member to move said valve member between the closed position and the open position; and a bar code reader for reading a bar code printed on a given container placed under said nozzle, wherein the bar code indicates a volume for the given container; and a controller which responds to a signal from said bar code readers which indicates the volume for the given container by operating said actuator to move said valve member into the open position for an interval of time which is determined based on the signal from said bar code reader.

6. The apparatus as recited in claim 5 wherein:

the bar code also identifies a serial number of the given container;

the signal from said bar code reader also indicates the serial number of the given container; and said controller stores data indicating serial numbers of containers into which beverage has been dispensed previously and responds to the signal from said bar code reader by operating said valve to dispense beverage from said nozzle if the data indicates that beverage was not previously dispensed into a container having an identical serial number as the given container.

7. The apparatus as recited in claim 5 wherein said controller operates said valve to terminate beverage dispensing when said bar code reader indicates that the given container has been removed from beneath the nozzle.

8. A system, for dispensing a beverage, comprising:

a serving container having an exterior surface on which is an indicia of a volume;

a nozzle having an outlet through which the beverage is dispensed;

a valve coupled to said nozzle for controlling the flow of the beverage through said nozzle;

a mechanism for reading the indicia when said serving container has been placed beneath said nozzle, and producing a signal which indicates the volume for said serving container; and a controller which responds to the signal from said mechanism by operating said valve to dispense beverage from said nozzle, wherein a quantity of beverage dispensed is determined in response to the signal.

9. The apparatus as recited in claim 8 wherein:

the indicia also identifies a serial number of the serving container;

the signal produced by said mechanism also indicates the serial number of the serving container; and said controller stores data which indicates serial numbers of containers into which beverage has been dispensed previously and responds to the signal from said mechanism by operating said valve to dispense beverage from said nozzle only if the data does not indicate that beverage was previously dispensed into a container having an identical serial number as the serving container.

10. A method for dispensing a beverage into a container, wherein said method comprises:

reading an indicia printed on the container that has been placed beneath the nozzle, wherein the indicia indicates a volume for the container;

opening a valve which controls flow of the beverage through a nozzle to dispense the beverage into the container; and closing the valve after a predefined quantity of beverage has flowed through the nozzle, wherein the predefined quantity of beverage is determined in response the volume for the container indicated by the indicia.

11. The method as recited in claim 10 wherein the step of closing the valve occurs a predefined interval of time after the valve is opened wherein the predefined interval of time is determined in response the volume for the container indicated by the indicia.

12. The method as recited in claim 10 wherein the step of reading an indicia printed on the container also indicates a serial number for the container placed under the nozzle; and further comprising:

maintaining data in a memory which indicates the serial numbers of containers into which beverage is dispensed; and the step of opening the valve occurs only if the data indicates that beverage had not been dispensed previously into a container with the serial number of the container placed under the nozzle.

13. The method as recited in claim 10 further comprising closing the valve when said step of reading an indicia printed on the container indicates that the container has been removed from beneath the nozzle.

* * * * *